US008698785B2

(12) United States Patent
Cheng et al.

(10) Patent No.: US 8,698,785 B2
(45) Date of Patent: Apr. 15, 2014

(54) IMAGE ADJUSTING APPARATUS

(75) Inventors: Chun-Ming Cheng, Taipei County (TW); Tsung-Hsiang Huang, Changhua County (TW)

(73) Assignee: Princeton Technology Corporation, Taipei County (TW)

( * ) Notice: Subject to any disclaimer, the term of this patent is extended or adjusted under 35 U.S.C. 154(b) by 1384 days.

(21) Appl. No.: 12/068,070

(22) Filed: Feb. 1, 2008

(65) Prior Publication Data

US 2009/0051709 A1 Feb. 26, 2009

(30) Foreign Application Priority Data

Aug. 23, 2007 (TW) ..... 96214035 U

(51) Int. Cl.
*G09G 3/22* (2006.01)

(52) U.S. Cl.
USPC ..... 345/204; 345/690; 345/75.2

(58) Field of Classification Search
None
See application file for complete search history.

(56) References Cited

U.S. PATENT DOCUMENTS

| | | | | |
|---|---|---|---|---|
| 6,891,524 | B2 * | 5/2005 | Sakashita | 345/89 |
| 2001/0024199 | A1 * | 9/2001 | Hughes et al. | 345/204 |
| 2003/0058202 | A1 * | 3/2003 | Evanicky et al. | 345/82 |
| 2003/0156225 | A1 * | 8/2003 | Ito et al. | 348/649 |
| 2004/0189626 | A1 * | 9/2004 | Mori | 345/204 |

* cited by examiner

*Primary Examiner* — Joseph Haley
(74) *Attorney, Agent, or Firm* — Muncy, Geissler, Olds & Lowe, P.C.

(57) ABSTRACT

An image adjusting apparatus is provided for adjusting the color of an image. The image adjusting apparatus includes a converting module, a processing module, an output module, a display module, a measuring module and a computing module. The converting module converts an input image into an image signal. The processing module is coupled with the converting module for adjusting the image signal and generating an output signal according to a gain value. The output module is coupled with the processing module for generating an output image according to the output signal. The display module is coupled with the output module for displaying the output image. The measuring module is coupled with the display module for measuring the output image and generating a measurement. The computing module is coupled with the measuring module and the processing module for generating the gain value according to the measurement.

12 Claims, 1 Drawing Sheet

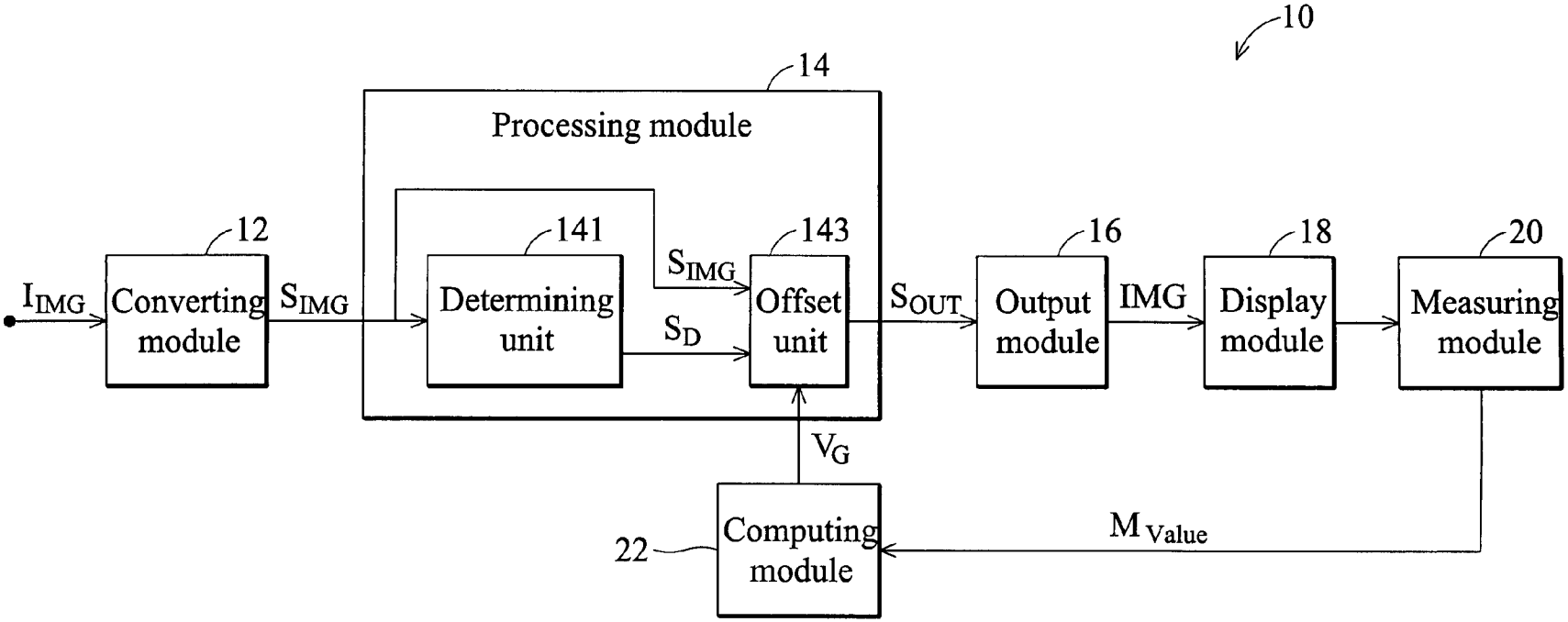
10
$I_{IMG}$
12
Converting module
$S_{IMG}$
14
Processing module
141
Determining unit
$S_{IMG}$
$S_D$
143
Offset unit
$S_{OUT}$
16
Output module
IMG
18
Display module
20
Measuring module
$M_{Value}$
$V_G$
22
Computing module

IMAGE ADJUSTING APPARATUS

BACKGROUND

The invention relates to an image adjusting apparatus, and in particular to an image adjusting apparatus used for adjusting color of an image.

This section is intended to introduce the reader to various aspects of art, which may be related to various aspects of the present invention, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

Similar to a general cathode ray tube (CRT), a field emission display (FED) emits light by beaming high-energy electrons to an image component (pixel) of a screen, and the electronic energy is transformed to visible light by excited fluorescent material. A conventional CRT scans a grating of a screen with one or three electron beams. On the contrary, an FED scans color components of each pixel with a fixed electron beam. Comparing distances between a source of electron beams and the screen for a conventional CRT, and an electron source and a screen for an FED, the FED distance is much shorter. In addition, FEDs are energy efficient when compared to CRTs. Accordingly, FEDs have recently become popular.

For an FED, however, color shift occurs when color of red, green, and blue of each pixel changes as the lightness changes, thereby color of an image is distorted. Accordingly, there is a need for a technology to address the color shift problems which occur in an image under low lightness.

Accordingly, an image adjusting apparatus is needed to adjust color in an image under low lightness, thereby improving quality of image.

SUMMARY

Certain aspects commensurate in scope with the originally claimed invention are set forth below. It should be understood that these aspects are presented merely to provide the reader with a brief summary of certain forms the invention might take and that these aspects are not intended to limit the scope of the invention. Indeed, the invention may encompass a variety of aspects that may not be set forth below.

An image adjusting apparatus is provided for adjusting the color of an image. The image adjusting apparatus includes a converting module, a processing module, an output module, a display module, a measuring module and a computing module. The converting module converts an input image into an image signal. The processing module is coupled with the converting module for adjusting the image signal and generating an output signal according to a gain value. The output module is coupled with the processing module for generating an output image according to the output signal. The display module is coupled with the output module for displaying the output image. The measuring module is coupled with the display module for measuring the output image and generating a measurement. The computing-module is coupled with the measuring module and the processing module for generating the gain value according to the measurement.

BRIEF DESCRIPTION OF DRAWINGS

The invention can be more fully understood by reading the subsequent detailed description and examples with references made to the accompanying drawings, wherein:

FIG. 1 illustrates a schematic view of an embodiment of an image adjusting apparatus.

DETAILED DESCRIPTION

One or more specific embodiments of the invention are described below. In an effort to provide a concise description of these embodiments, not all features of an actual implementation are described in the specification. It should be appreciated that in the development of any such actual implementation, as in any engineering or design project, numerous implementation-specific decisions must be made to achieve specific developer goals, such as compliance with system-related and business-related constraints, which may vary from one implementation to another. Moreover, it should be appreciated that such a development effort might be complex and time consuming, but would nevertheless be a routine undertaking of design, fabrication, and manufacturing for those of ordinary skill in the art having the benefit of this disclosure.

In the following detailed description, reference is made to the accompanying drawings which form a part hereof, shown by way of illustration of specific embodiments. These embodiments are described in sufficient detail to enable those skilled in the art to practice the invention, and it is to be understood that other embodiments may be utilized and that structural, logical and electrical changes may be made without departing from the spirit and scope of the invention. The following detailed description is, therefore, not to be taken in a limiting sense. The leading digit(s) of reference numbers appearing in the figures corresponds to the figure number, with the exception that the same reference number is used throughout to refer to an identical component which appears in multiple figures. It should be understood that the many of the elements described and illustrated throughout the specification are functional in nature and may be embodied in one or more physical entities or may take other forms beyond those described or depicted.

FIG. 1 illustrates a schematic view of an embodiment of an image adjusting apparatus. An image adjusting apparatus 10 is provided for adjusting the color of an image. The image adjusting apparatus 10 comprises a converting module 12, a processing module 14, an output module 16, a display module 18, a measuring module 20, and a computing module 22. The converting module 12 converts an input image $I_{IMG}$ into an image signal $S_{IMG}$. The processing module 14, coupled with the converting module 12, adjusts the image signal $S_{IMG}$ according to a gain value $V_G$ to generate an output signal $S_{OUT}$. The output module 16, coupled with the processing module 14, generates an output image IMG according to the output signal $S_{OUT}$ The display module 18, coupled with the output module 16, displays the output image IMG. According to an embodiment, display module 18 is a field emission display (FED). The measuring module 20, coupled with the display module 18, measures the output image IMG to accordingly generate a measurement $M_{value}$. Here, the measuring module 20 is a color thermometer, wherein the color thermometer detects color information of the output image IMG to generate the measurement $M_{value}$. The computing module 22, coupled with the measuring module and the processing module 14, generates the gain value $V_G$ according to the measurement $M_{value}$.

The converting module 12 converts the input image $I_{IMG}$ into the image signal $S_{IMG}$, conforming to a specific image format. Here, the specific image format is an RGB image format.

The processing module 14 comprises a determining unit 141 and an offset unit 143. The determining unit 141 determines whether the image signal $S_{IMG}$ is within a preset range, and generates a decision signal $S_D$ according to a result of the determining step. The offset unit 143, coupled with the determining unit 141, adjusts the image signal $S_{IMG}$ according to the decision signal $S_D$ and the gain value $V_G$ to generate the output signal $S_{OUT}$. The processing module 14 determines whether lightness of the image signal $S_{IMG}$ is within a preset range, and if so, the determining unit 141 generates the decision signal $S_D$, the processing module 14 adjusts the image signal $S_{IMG}$ according to the decision signal $S_D$ and the gain value $V_G$ to generate the output signal $S_{OUT}$, otherwise, the processing module 14 directly outputs the image signal $S_{IMG}$ as the output signal $S_{OUT}$ to the output module 16. Here, the preset range specifies that the lightness of the image signal $S_{IMG}$ is lower than 20%. The preset range can be set to meet requirements. In this embodiment, the lightness of the image signal $S_{IMG}$ lower than 20% specifies that lightness below 20% is regarded as low lightness. Only when it is determined that the image signal $S_{IMG}$ is below the low lightness level, the processing module 14 will then adjust the image signal $S_{IMG}$, otherwise, the processing module 14 directly outputs the image signal $S_{IMG}$ as the output signal $S_{OUT}$.

In addition, according to an embodiment, the display module 18 generates a plurality of output images IMG according to a plurality of conditions, and the measuring module 20 measures a plurality of measurements corresponding to the plurality of output images IMG, wherein each of the plurality of conditions is a color temperature value. The computing module 22 comprises a mapping table (not shown), wherein the mapping table (not shown) comprises a plurality of conditions and a plurality of gain values ($V_G$) corresponding thereto, wherein each of the plurality of measurements (measurement $M_{value}$) corresponds to one of the gain values ($V_G$). The offset unit 143 adjusts the image signal $S_{IMG}$ according to the gain value $V_G$ corresponding to the measurement $M_{value}$ measured by the measuring module 20 to generate the output signal $S_{OUT}$. Here, when the display module 18 is manufactured, output signal $S_{OUT}$ under different color temperatures are measured by measuring module 20 to generate corresponding measurement $M_{value}$. Gain value $V_G$ corresponding to the measurement $M_{value}$ are generated accordingly. The color temperature and corresponding gain value $V_G$ are recorded in a mapping table (not shown).

Accordingly, automatic adjustment for the image signal $S_{IMG}$ can be performed simply by referring to the mapping table, thereby an adjusted image signal $S_{IMG}$ can be generated without performing measurement. Accordingly, it is more convenient for a user.

According to the embodiments, an image adjusting apparatus is provided to adjust color in an image under low lightness, thereby addressing the color shift problems occurring in an image under low lightness and improving quality of image.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An image adjusting apparatus, adjusting color of an image, comprising:

a converting module, converting an input image into an image signal;

a processing module, coupled with the converting module, determining whether lightness of the image signal is lower than a predetermined value, and if so, adjusting the image signal according to a gain value to generate an output signal, otherwise directly outputting the image signal as the output signal;

an output module, coupled with the processing module, generating an output image according to the output signal;

a display module, coupled with the output module, displaying the output image;

a measuring module, coupled with the display module, measuring the output image to accordingly generate a measurement; and a computing module, coupled with the measuring module and the processing module, generating the gain value according to the measurement.

2. The image adjusting apparatus of claim 1, wherein the converting module converts the input image into the image signal conformed to a specific image format.

3. The image adjusting apparatus of claim 2, wherein the specific image format is an RGB image format.

4. The image adjusting apparatus of claim 1, wherein the display module is a field emission display (FED).

5. The image adjusting apparatus of claim 1, wherein the processing module comprises:

a determining unit, determining whether the lightness of the image signal is lower than the predetermined value, and generating a decision signal according to a result of the determining step; and an offset unit, coupled with the determining unit, adjusting the image signal according to the decision signal and the gain value to generate the output signal.

6. The image adjusting apparatus of claim 5, wherein the predetermined value is 20%.

7. The image adjusting apparatus of claim 5, wherein the display module generates a plurality of output images according to a plurality of conditions, and the measuring module measures a plurality of measurements corresponding to the plurality of output images.

8. The image adjusting apparatus of claim 7, wherein the computing module comprises a mapping table, wherein the mapping table comprises a plurality of conditions and a plurality of gain values corresponding thereto.

9. The image adjusting apparatus of claim 8, wherein each of the plurality of conditions is a color temperature value.

10. The image adjusting apparatus of claim 8, wherein each of the plurality of measurements corresponds to one of the gain values.

11. The image adjusting apparatus of claim 10, wherein the offset unit adjusts the image signal according to the gain value corresponding to the measurement measured by the measuring module to generate the output signal.

12. The image adjusting apparatus of claim 1, wherein the measuring module is a color thermometer, wherein the color thermometer detects color information of the output image to generate the measurement.

* * * * *